United States Patent [19]

Westergren

[11] 4,012,091

[45] Mar. 15, 1977

[54] VACUUM CLEANER WITH REPLACEABLE ELECTRICAL TERMINALS

[75] Inventor: George Alfred Westergren, White Bear Lake, Minn.

[73] Assignee: Whirlpool Corporation, Benton Harbor, Mich.

[22] Filed: Nov. 7, 1975

[21] Appl. No.: 629,844

[52] U.S. Cl. ..... 339/15; 285/7; 339/276 T

[51] Int. Cl.[2] ..... H01R 3/04

[58] Field of Search ..... 339/15, 16 R, 276 F, 339/276 T; 285/7

[56] References Cited

UNITED STATES PATENTS

| | | | |
|---|---|---|---|
| 3,034,085 | 5/1962 | Pauler et al. | 339/16 R |
| 3,127,227 | 3/1964 | Edwards | 339/15 |

*Primary Examiner*—Roy Lake
*Assistant Examiner*—DeWalden W. Jones
*Attorney, Agent, or Firm*—Wegner, Stellman, McCord, Wiles & Wood

[57] ABSTRACT

A current-carrying vacuum cleaner hose having improved replaceable electrical terminals. The terminals are carried on a mounting member to define a terminal adaptor which is engageable with terminals carried by the hose end. The terminal adaptor is arranged to permit an electrical connector to be removably connected to the terminals thereof and in the illustrated embodiment, defines an electrical receptacle. The terminal adaptor may be retained in association with the hose end by a snap-in hose end adaptor or may be secured to the hose end by securing means associated with the hose end.

14 Claims, 7 Drawing Figures

VACUUM CLEANER WITH REPLACEABLE ELECTRICAL TERMINALS

BACKGROUND OF THE INVENTION

1. Field of the Invention

This invention relates to vacuum cleaner structures and in particular to terminal means for use in current-carrying vacuum cleaner hoses.

2. Description of the Prior Art

In one conventional form of vacuum cleaner, as shown in U.S. Pat. No. 3,034,085 of Charles J. Pauler et al, which patent is owned by the assignee hereof, a flexible hose is connected at one end to a suction unit. The opposite end of the flexible hose is provided with a coupler adapted to be telescopically received in a tubular connector of a floor tool. The hose is provided with electrical wires for conducting electricity from the suction unit to the floor unit which conventionally may include electrical means, such as a motor driven brush means. As shown in the Pauler et al patent, the coupler on the first end may carry a male electrical connector having exposed terminals for engagement with a female electrical connector carried by the suction unit. The opposite end coupler may carry a female connector adapted to have electrical conductive connection with a complementary male connector carried on the floor tool. The hose shown in the Pauler et al patent is relatively inconvenient and expensive to repair in the event that one or more of the male connector terminals is damaged in that the entire hose end assembly must be replaced involving considerable time and expense.

In U.S. Pat. No. 2,516,864 of Arville W. Gilmore et al, a method of making a hose from elastomeric composition is shown wherein the electrical connections are made within a molded-on hose end.

In William T. Wickham et al U.S. Pat. No. 3,636,285, a vacuum cleaner hose assembly is shown wherein female connectors are embedded in one hose end and male connectors are fixed in the other hose end. Separate electrical cords are provided for interconnecting other terminals at the opposite ends of the hose.

Charles E. Edwards, in U.S. Pat. No. 3,127,227, shows a vacuum cleaner connector which is secured to the hose conductors and retained within a housing portion defined by the hose end.

In James Pritulsky U.S. Pat. No. 3,546,656, an electrical connector assembly is disclosed wherein a terminal is provided in the hose end for connection to the end of a flat conductor carried by the hose. The terminal defines spring contact members.

SUMMARY OF THE INVENTION

The present invention comprehends an improved replaceable electrical terminal means for use in a current-carrying vacuum cleaner hose.

The replaceable terminal means may comprise a terminal adaptor removably connected to the hose end to have electrical connection with contacts provided within the hose end attached to the hose wires.

The terminal adaptor may be secured to the hose end by conventional means, such as screws or the like, and in the illustrated embodiment, is retained in association with the hose end by a snap-in hose end adaptor defining the coupling means of the hose end.

The retaining means may define a housing about the adaptor terminals thereby defining an electrical receptacle for connection thereto of a conventional electrical connector.

The terminal adaptor may include solid male terminals carried on a mounting member so as to project from opposite faces of the mounting member. The mounting member may be clamped to the hose end by the securing means.

The terminal adaptor is readily replaceable in the hose construction of the present invention for facilitated maintenance as the hose end need not be replaced in the replacement of the terminal means.

The terminal adaptor is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figures 1, 2, 3, 4, 5, 6, 7:
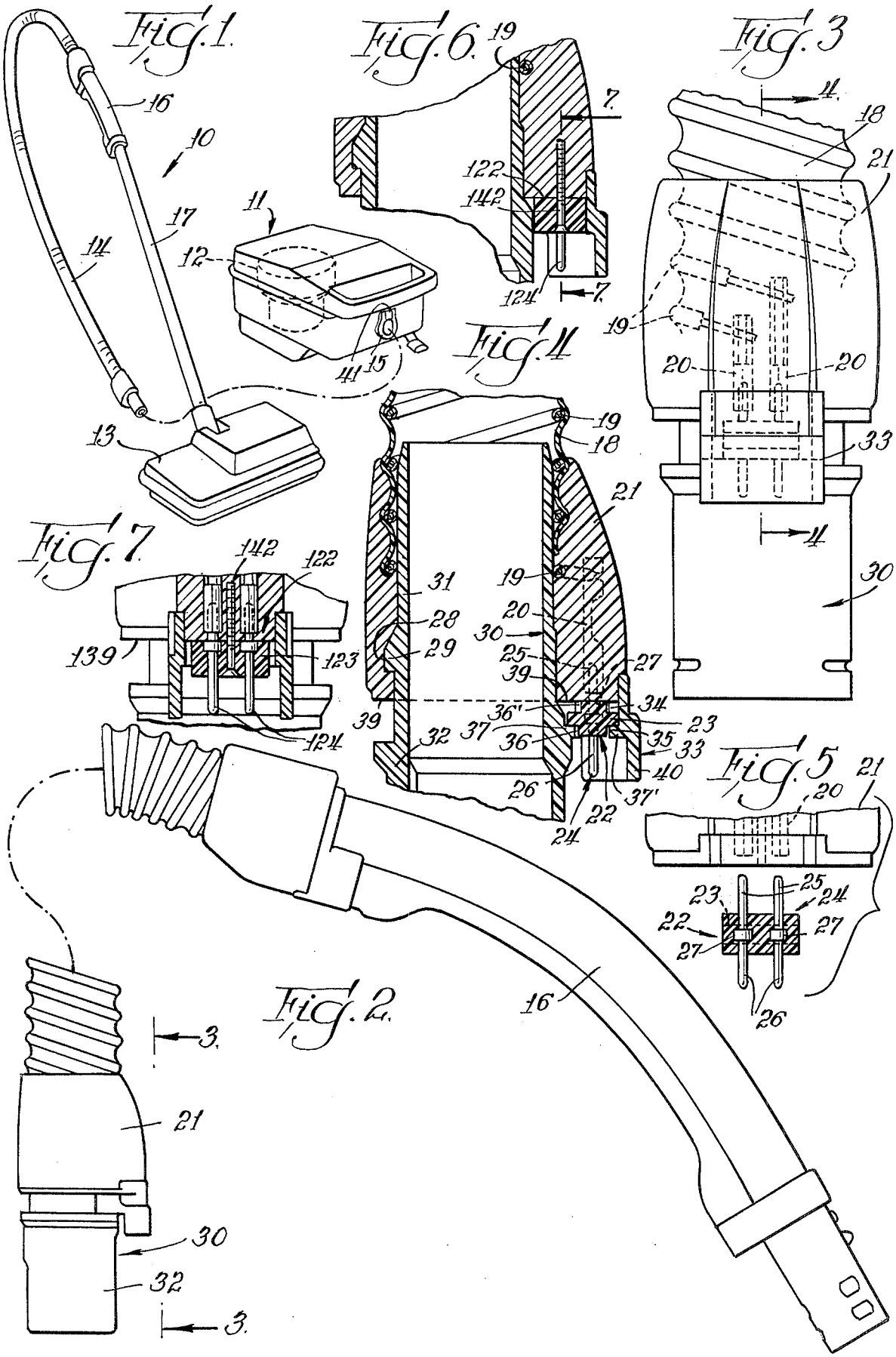
FIG. 1 is a perspective view of a vacuum cleaner having an improved current-carrying hose embodying the invention.
FIG. 2 is a broken side elevation of the hose.
FIG. 3 is a fragmentary plan elevation of one end of the hose provided with a terminal adaptor embodying the invention.
FIG. 4 is a diametric section taken substantially along the line 4—4 of FIG. 3.
FIG. 5 is a partial exploded view with the terminal adaptor in section and a portion of the hose end in elevation.
FIG. 6 is a fragmentary diametric section illustrating a modified form of the invention.
FIG. 7 is a section taken substantially along the line 7—7 of FIG. 6.

In the exemplary embodiments of the invention as disclosed in the drawing, a vacuum cleaner generally designated 10 is shown to include a canister 11 having an air suction means 12. A floor unit 13 is connected to the canister by means of a hose 14 connected at one end to a coupling 15 on the canister, and at the other end, is provided with a handle 16 adapted to be connected to a wand 17 of the floor unit.

Hose 14 may comprise a current-carrying hose provided with a flexible duct wall 18 and carrying electrical spring wire conductors 19.

As shown in FIG. 3, the wires 19 are provided with a pair of female terminals 20 which effectively define electrical contacts embedded within a molded hose end portion 21 on the end of the flexible hose 18 and effectively defining the hose end.

The present invention comprehends the provision of a terminal adaptor generally designated 22 which is removably connected to the molded hose end portion 21 to define a removable extension of the terminals 20.

The terminal adaptor includes a mounting member 23 which may be formed of a suitable insulating material, such as synthetic resin, and a pair of extension terminals 24. Terminals 24 comprise double-ended male terminals having an inner end portion 25 received in the female terminal 20, an outer end portion 26 exposed outwardly of the mounting member, and an enlarged portion 27 positioned in the mounting member 23. In this embodiment, mounting member 23 is injection molded with terminals 24 held in proper orientation relative to member 23 as it is formed, thus locking enlarged portions 27 in the body of insulating material.

In the preferred form of the invention, the terminal adaptor is retained in association with the molded hose end 21 with the terminal portions 25 in electrical contact association with terminals 20 by a hose end adaptor 30 having a tubular portion 31 received within the molded hose end 21 and an outer portion 32 extending outwardly therefrom to define a coupling such as for coupling the hose end to the floor unit 13. Molded hose end 21 is provided with a slot 28 adapted to receive flange 29 on tubular portion 31 of hose end adaptor 30 to provide snap-in mounting and retaining of the hose end adaptor 30 to molded hose end 21.

Extension 30 may be provided with a retainer portion 33 defining a recess 34 receiving the terminal adaptor mounting member. Retainer 33 further defines a through opening 35 for receiving a shoulder portion 36 of the mounting member 23. Thus, the wall portion 37 and 37′ of the retainer portion 33 outwardly of the main portion of the mounting member 23 define a retaining wall which, when the hose end adaptor 30 is assembled to the molded hose end 21, clamps shoulder 36′ of the mounting member 23 against the outer surface 39 of the molded hose end to retain the terminal adaptor in association with the molded hose end with terminals 25 connected to terminals 20. Retainer portion 33 further defines an enclosure portion 40 cooperating with the extension portion 32 to define a receptacle for receiving an electrical connector to be electrically connected to the terminal portions 26. The connector 15 may include an electrical connector portion 41 adapted to be received in the receptacle when the tubular portion 32 of the hose end adaptor is connected in the connector 15.

As will be obvious to those skilled in the art, the terminal adaptor could incorporate outer female terminals for cooperation with a male electrical connector, as desired.

In a modified form of the invention as shown in FIGS. 6 and 7, a terminal adaptor generally designated 122 is shown to comprise a terminal adaptor generally similar to adaptor 22 but arranged to be secured to the molded hose end 21 by securing means, such as threaded member 142. As shown in FIG. 7, the threaded member may comprise a screw extending through the mounting member 123 intermediate the terminals 124 and threaded into the molded hose end to maintain the mounting member in facial abutment with the outer surface 139 of the molded hose end.

As will be obvious to those skilled in the art, other suitable securing means may be utilized in lieu of the threaded means 142, including clamp means, adhesive means, fastener means, etc., within the scope of the invention. The invention comprehends, however, that the securing means be arranged to permit ready removability of the terminal adaptor when desired while yet fixedly associating the terminal adaptor with the hose end in the normal use of the hose.

As discussed above, the use of terminal adaptors 22 and 122 provides facilitated low cost maintenance while further providing an improved electrical connector receptacle for improved facilitated connection of the hose end both in air transfer association and electrically conductive association with associated vacuum cleaner structure. In particular, in the FIG. 2–5 embodiment the hose end adaptor 30 can be detached from the molded hose end 21 and terminal adaptor 22 replaced and the hose end adaptor can be reattached to the hose end 21. In the case of the FIG. 6 and 7 embodiment, replacement of the terminal adaptor 122 is accomplished as described above by releasing retainer 142. Thus, both embodiments provide for facilitated low cost repair of a vacuum cleaner hose compared to previous hoses as shown in the aforementioned Pauler et al patent.

Molded hose ends 21 are the subject of co-pending Lyman patent application, Ser. No. 629,842 entitled "Vacuum Cleaner Hose End With Electrical Terminals", filed on Nov. 7, 1975 with this application and assigned to the assignee of this application. The hose end adaptor 30 is the subject of co-pending Lyman et al patent application, Ser. No. 629,843, entitled "Vacuum Cleaner Hose End Structure", filed on Nov. 7, 1975 with this application and assigned to the assignee of this application.

The foregoing disclosure of specific embodiments is illustrative of the broad inventive concepts comprehended by the invention.

Having described the invention, the embodiments of the invention in which an exclusive property or privilege is claimed are defined as follows:

1. In a current-carrying vacuum cleaner hose having an end provided with a pair of exposed electrical contacts, the improvement comprising:
   a terminal adaptor including a mounting member, and a pair of double-ended electrical terminals carried by said mounting member having a first end engaging said hose and electrical contacts, and an exposed opposite end; and
   means for releasably retaining said adaptor adjacent said hose end with the first end of said terminals in electrical contact with said hose end contacts, said adaptor being arranged to permit an electrical connector to be removably connected to the opposite exposed end of said terminals.

2. The vacuum cleaner hose improvement of claim 1 wherein said means for releasably retaining said adaptor comprises means for securing the mounting member to said hose end.

3. The vacuum cleaner hose improvement of claim 1 wherein said means for releasably retaining said adaptor comprises threaded means for securing the mounting member to said hose end.

4. The vacuum cleaner hose improvement of claim 1 wherein said terminals include an enlarged portion intermediate said ends and positioned in said mounting member for mounting said terminals to said member with said terminal ends extending oppositely outwardly from opposite sides of the mounting member.

5. The vacuum cleaner hose improvement of claim 1 wherein said mounting member comprises an insulating member carrying said terminals.

6. In a current-carrying vacuum cleaner hose having an end provided with a pair of exposed female terminals, the improvement comprising:
   a male terminal adaptor including a mounting member, and a pair of solid electrical terminals carried by said mounting member; and
   means for releasably retaining said terminal adaptor adjacent said hose end with said male terminals having inner portions received in said hose end female terminals, said male terminals including exposed outer portions arranged to have an electrical connector removably connected thereto.

7. The vacuum cleaner hose improvement of claim 6 wherein said hose end defines a molded end portion, said female terminals being embedded in said molded end portion, and said mounting member being facially engaged with said molded end portion adjacent said female terminals.

8. The vacuum cleaner hose improvement of claim 6 wherein means are connected to said hose end forming a retainer extending about said exposed outer portions of said female terminals to define an electrical connector receptacle.

9. In a current-carrying vacuum cleaner hose having an end provided with a pair of exposed electrical contacts and a tubular hose end adaptor adapted to be received in a female air connector, the improvement comprising:

a terminal adaptor including a mounting member, and a pair of electrical terminals carried by said mounting member; and means on said hose end adaptor for releasably retaining said terminal adaptor adjacent said hose end with said terminals in electrical contact with said hose end electrical contacts, said terminal adaptor being arranged to permit an electrical connector to be removably connected to said terminals.

10. The vacuum cleaner hose improvement of claim 9 wherein said hose end adaptor comprises a snap-on fitting.

11. The vacuum cleaner hose improvement of claim 9 wherein said means on said hose end adaptor for releasably retaining said terminal adaptor comprises means for retaining the terminal adaptor means defining an electrical connector receptacle.

12. The vacuum cleaner hose improvement of claim 9 wherein said means on said hose end adaptor for releasably retaining said terminal adaptor clamps said terminal adaptor to said hose end.

13. The vacuum cleaner hose improvement of claim 9 wherein said contacts comprise female terminals, said terminal adaptor terminals comprise male terminals, and said means on said hose end adaptor for releasably retaining said terminal adaptor defines means for retaining the male terminals connected to said female terminals.

14. The vacuum cleaner hose improvement of claim 9 wherein said terminal adaptor retaining means is integral with said hose end adaptor.

* * * * *